US006375009B1

(12) United States Patent
Lee

(10) Patent No.: US 6,375,009 B1
(45) Date of Patent: Apr. 23, 2002

(54) BAG WITH A SHOCK ABSORBING UNIT

(76) Inventor: Chung Kyun Lee, Youngwoon Apt., Dadong 407, #1003-22, Hwagok-dong, Gangseo-Ku, Seoul 157-010 (KR)

( * ) Notice: Subject to any disclaimer, the term of this patent is extended or adjusted under 35 U.S.C. 154(b) by 0 days.

(21) Appl. No.: 09/601,865

(22) PCT Filed: Feb. 9, 1999

(86) PCT No.: PCT/KR99/00063

§ 371 Date: Aug. 9, 2000

§ 102(e) Date: Aug. 9, 2000

(87) PCT Pub. No.: WO99/39607

PCT Pub. Date: Aug. 12, 1999

(30) Foreign Application Priority Data

Feb. 10, 1998 (KR) ..... 98-3792
Jul. 16, 1998 (KR) ..... 98-13130 U

(51) Int. Cl.[7] ..... B65D 81/03
(52) U.S. Cl. ..... 206/522; 206/591; 206/594
(58) Field of Search ..... 206/522, 591, 206/594; 383/3; 190/102, 124, 125

(56) References Cited

U.S. PATENT DOCUMENTS 3,587,794 A * 6/1971 Mattel
4,044,867 A * 8/1977 Fisher ..... 206/522
4,569,082 A 2/1986 Ainsworth et al.
4,573,202 A * 2/1986 Lee ..... 383/3
4,801,213 A 1/1989 Frey et al.
5,217,131 A * 6/1993 Andrews ..... 206/522
5,819,942 A * 10/1998 Sadow ..... 206/522

FOREIGN PATENT DOCUMENTS

| | | |
|---|---|---|
| DE | 2 218 759 | 10/1973 |
| FR | 2 613 197 | 10/1988 |
| FR | 2 674 411 | 10/1992 |

* cited by examiner

*Primary Examiner*—David T. Fidei
(74) *Attorney, Agent, or Firm*—Anderson Kill & Olick; Eugene Lieberstein; Michael Meller

(57) ABSTRACT

The present invention relates to a bag with a shock absorbing unit for protecting the bag's contents from external impacts. In the shock absorbing unit 1, upper and lower panels 2, 3 and the side shock absorbing member 4 include a plurality of air cells 5, 6, each of which is inflated with air and sealed. The shock absorbing unit 1 is either sewed or attached to a bag 10 having a soft or hard side surface in a detachable manner so as to absorb various external impacts from all directions when carrying the bag 10 and to receive the contents safely and conveniently. In addition, it also allows the contents to be easily taken out.

6 Claims, 5 Drawing Sheets

BAG WITH A SHOCK ABSORBING UNIT

FIELD OF THE INVENTION

The present invention relates to a bag with a shock absorbing unit. In particular, the shock absorbing unit is provided in either a soft cased bag or a hard cased bag in any appropriate manner which allows it to be detached/attached from/to the bag. Otherwise, the shock absorbing unit is sewed to the bag, and the shock absorbing material of the shock absorbing unit is arranged at the upper and lower panels of the bag as well as in the side walls of the bag. Therefore, the shock absorbing unit can absorb any external impact from all directions so that the bag can safely carry its contents. Besides, the configuration of the shock absorbing unit according to the present invention allows the contents to be easily put in and taken out of the bag.

BACKGROUND OF THE INVENTION

With the wide use of electronic equipment which is sensitive to impacts such as notebook computers, the need has arisen for a bag for safely and conveniently carrying such equipment. In general, the inner material of such a bag is of material such as elastic textile, panel or semi-hard foam attached on both sides of the bag by sewing or any other manner.

The receiving area of such a hard cased protective bag is conventionally finished off with a shock absorbing plastic such as semi-hard foam. Furthermore, the shape of the shock absorbing plastic is designed to accommodate the shape and size of predetermined contents. The bag described above can be made sufficiently strong to support and carry relatively heavy articles.

As well as hard cased bags, soft cased bags are also widely used for the purpose of carrying equipment which may be damaged by external shocks. The receiving area of a soft cased bag is usually finished off with a textile covered elastic panel. The soft cased bag has wire on its rim forming the rectangular bag shape. This wire supports the contents of the bag. The advantages of such a bag are that it is light and it looks delicate.

SUMMARY OF THE INVENTION

However, the hard cased bag described above has the disadvantages that it is not convenient to take objects out therefrom and it can provide only one receiving area. In addition, as the bag is designed so as to be suitable for receiving only objects of a predetermined shape and size, other smaller objects can be shaken about resulting in the failure to protect the contents from external impacts. On the other hand, in the case of a soft cased bag there is also the risk that the contents may be subjected to external impacts when the bag is carried. Therefore, the users of the bags described above have had to endure inconvenience when taking articles out of such bags and damage to the contents from external impacts.

Therefore, the object of the present invention is to overcome the above problems. In order to achieve the object, the present invention provides a bag having a shock absorbing unit therein for protecting the received contents from external impacts, the shock absorbing unit comprising upper and lower panels being air-cushioned with a plurality of air cells thereon for absorbing unexpected impacts caused at the top and bottom of the bag, each of the air cells being inflated with air and sealed; a side shock absorbing member filled with air and sealed for absorbing unexpected impacts caused at the side of the bag; a band connected to the side shock absorbing member and made of extensible elastic material; and a connecting member intended to cover the upper panel when the bag is closed, wherein the lower panel, the side shock absorbing member, the band and the connecting member are all connected making one piece and attached to an inner side wall of the bag, and the upper panel is attached to the upper portion of the inner side wall.

DETAILED DESCRIPTION OF THE INVENTION

Hereinafter, each embodiment of the present invention will be explained in detail with reference to the accompanying drawings, in which the same numbers indicate corresponding units.

The First Embodiment

Figure 1:
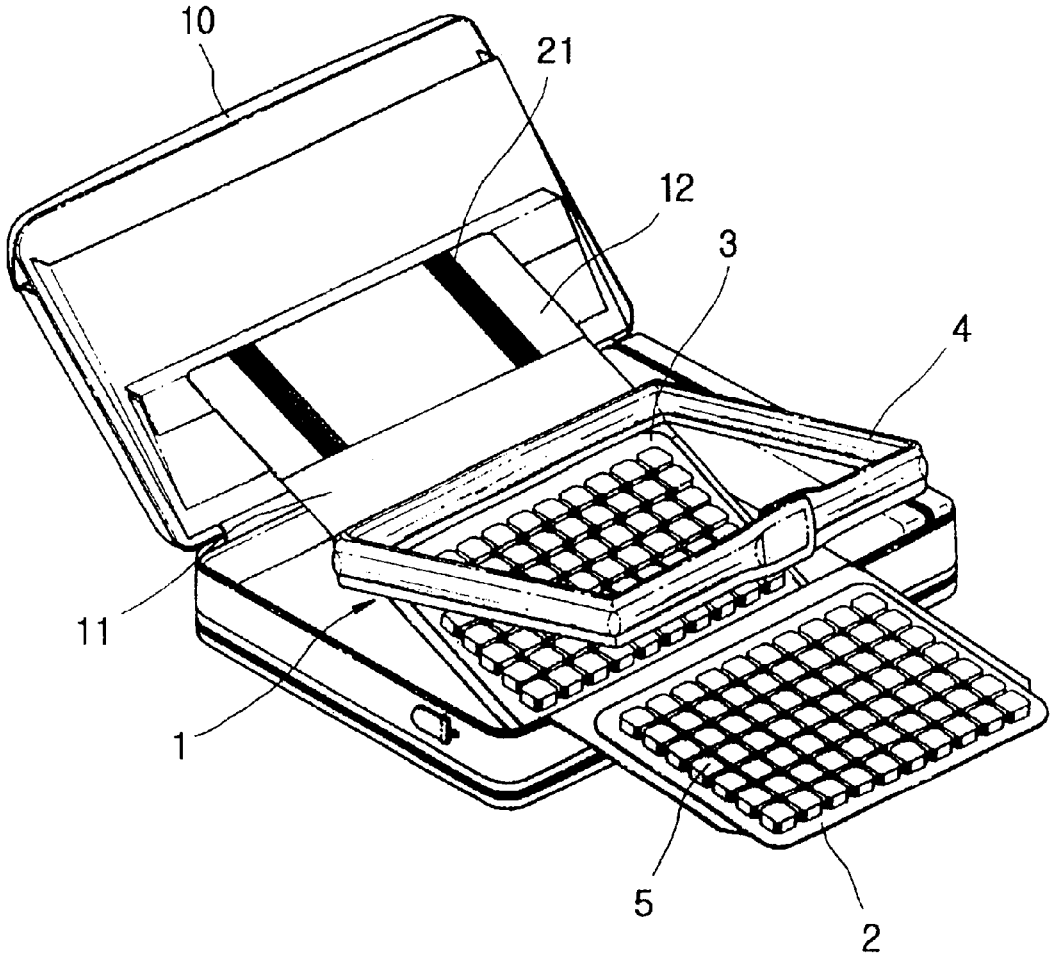
FIG. 1 is a perspective open view showing a bag with a shock absorbing unit according to the first embodiment of the present invention.

FIG. 1 is a perspective open view showing a bag with a shock absorber according to the first embodiment of the present invention. The bag 10 shown in the figure is a soft cased bag in which two pieces constituting the bag are joined together. However, the bag 10 can also be a hard cased bag. The shock absorbing unit 1 includes upper and lower panels 2, 3, a side shock absorbing member 4, a band 11 and a connecting member 12. The lower panel 3, the side shock absorbing member 4, the band 11 and the connecting member 12 are serially connected. They can be attached to an inner wall of the bag 10 by sewing a bonding portion 13 with hook and loop fastener (not shown) in an easily detachable manner. On the other hand, the upper panel 2 is sewed to the upper portion of the inner wall. When opening the bag 10, the shock absorbing unit 1 can be opened to release the contents. At the same time, each of the units can also be separated from each other. On the other hand, when closing the bag, the lower panel 3 is folded to form a right angle to the side shock absorbing member 4. At the same time, the side shock absorbing member 4 itself is folded to form a right angle at four points thereon. Then, the hook and loop fastener bonding portions 22 of the side shock absorbing member 4 are piled and bonded to surround the lower panel 3. As the upper panel 2 and the connecting member 12 are piled thereon, they can adhere to each other by the hook and loop fastener bonding portion 21 included in the connecting member 12.

Figure 2:
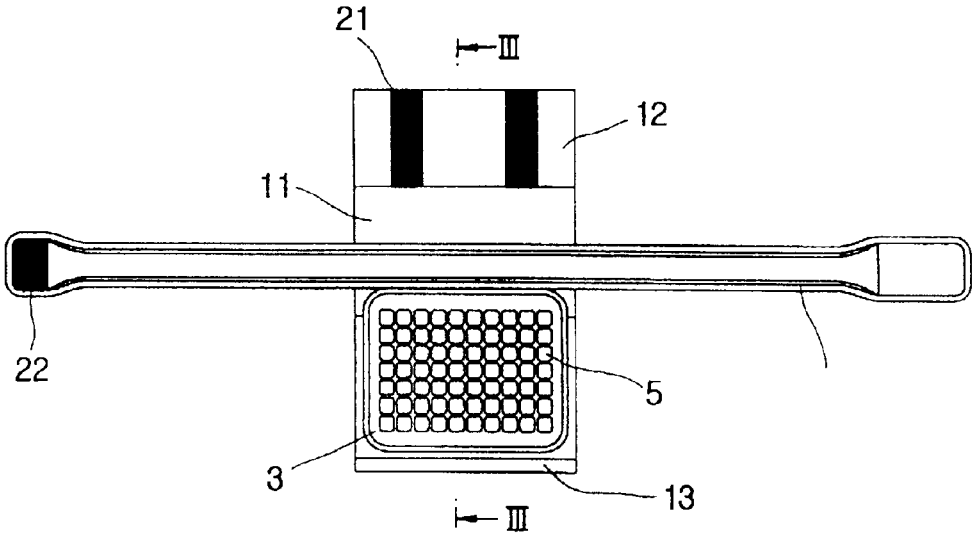
FIG. 2 is a development view of the shock absorbing unit according to the first embodiment of the present invention.

FIG. 2 is a development view of the shock absorbing unit according to the first embodiment of the present invention, in which the lower panel having a plurality of air cells, the side shock absorbing member, the band and the connecting member are laid out. In the figure, the lower panel 3, a side surface of the side shock absorbing member 4, the band 11 and the connecting member 12 are serially connected by sewing. The side shock absorbing member 4 should be long enough to surround four side rims of the lower panel 3, taking into consideration the piled length of the hook and loop fastener bonding portion 22 attached to both ends of the side shock absorbing member 4. The connecting member 12 includes the hook and loop fastener bonding portion 21 and a sponge to make it agreeable to the touch. While the width of the connecting member 12 is equal to the widths of the upper and lower panels 2, 3, it is preferable that the length of the connecting member 12 is longer than half of the length of the upper panel 2 such that the hook and loop fastener bonding portion 21 gives sufficient adhesive strength. The band 11, which is disposed between the side shock absorbing member 4 and the connecting member 12, is formed by an extensible elastic material such as a spandex or a neoprene. The position at which the hook and loop fastener bonding portion 21 is to be attached can be secured by use of the band 11, and the shock absorbing unit 1 can receive relatively big objects.

Figure 3:
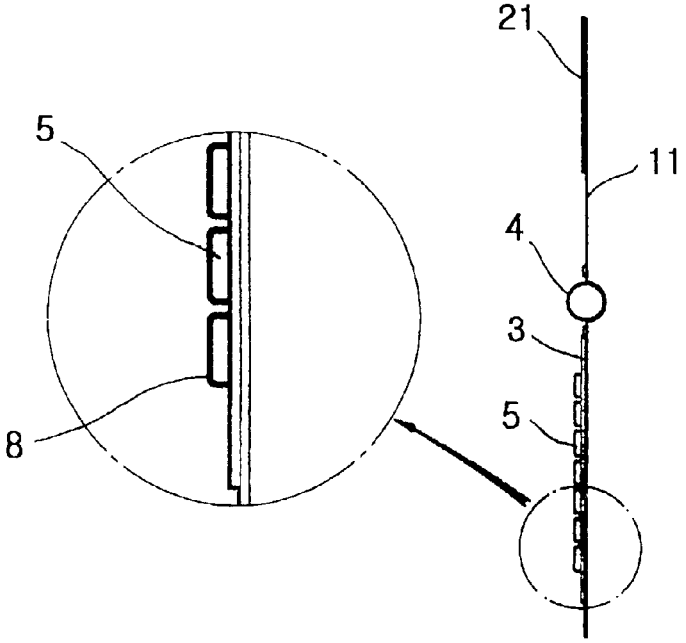
FIG. 3 shows a cross section view of a III—III line and a partially enlarged view of a shock absorbing unit in FIG. 2.

FIG. 3 is a III—III line cross section view and a partially enlarged view of the shock absorbing unit in FIG. 2. The upper panel has the same configuration and same operation as the lower panel 3 explained below, so an explanation with regard to the upper panel 2 is omitted. The upper and lower panels 2, 3 and the side shock absorbing member 4 act as a shock absorbing material. The lower panel 3 includes a plurality of the prominent air cells 5, which are arranged in a lattice pattern. Each prominent air cells 5 is formed by filling air in a TPU (Thermal polyurethane) and then sealing it. Because the prominent air cells 5 act as an air cushion, the effect of absorbing external impacts can be maximized. In addition, it is possible to improve the aesthetic appearance by covering their external surface with a covering cloth 8, or it is also possible to decorate them with a trade mark or other written advertisement by a compression molding with printing media without coating.

Figure 4:
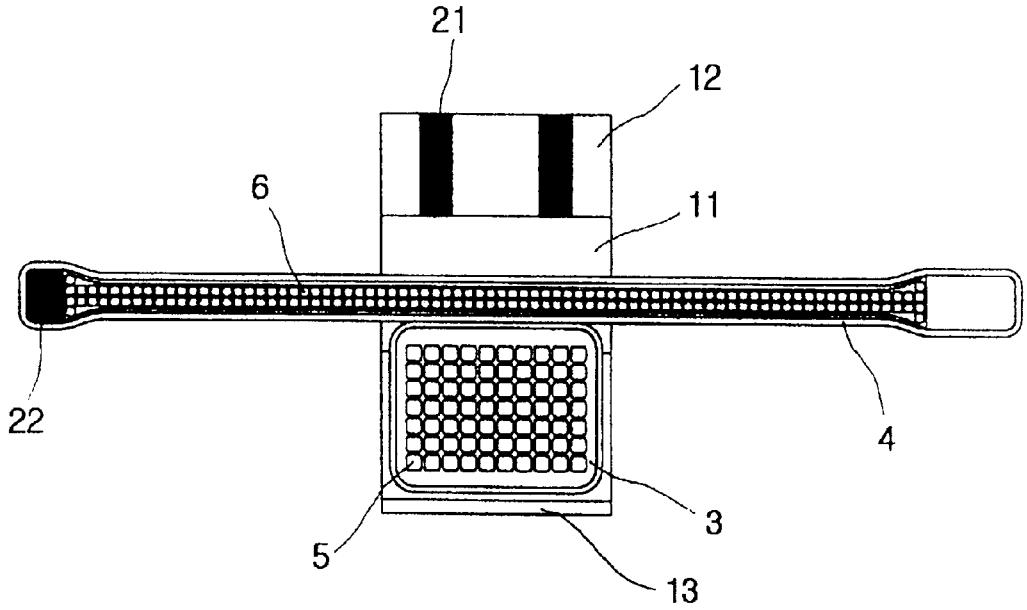
FIG. 4 is a development view of the shock absorbing unit having a second configuration still according to the first embodiment of the present invention.

The side shock absorbing member 4 can be formed in a bar type or can include a plurality of the prominent air cells 6 in an inner surface facing the contents of the bag 10, as shown in FIG. 4. The side shock absorbing member 4 is also covered with the covering cloth 8 together with the upper and lower panels 2, 3. That is required for supporting the weight of the contents by surrounding the content, fixing the content safely and creating an absorbing effect similar to the upper and lower panels 2, 3.

Figure 5:
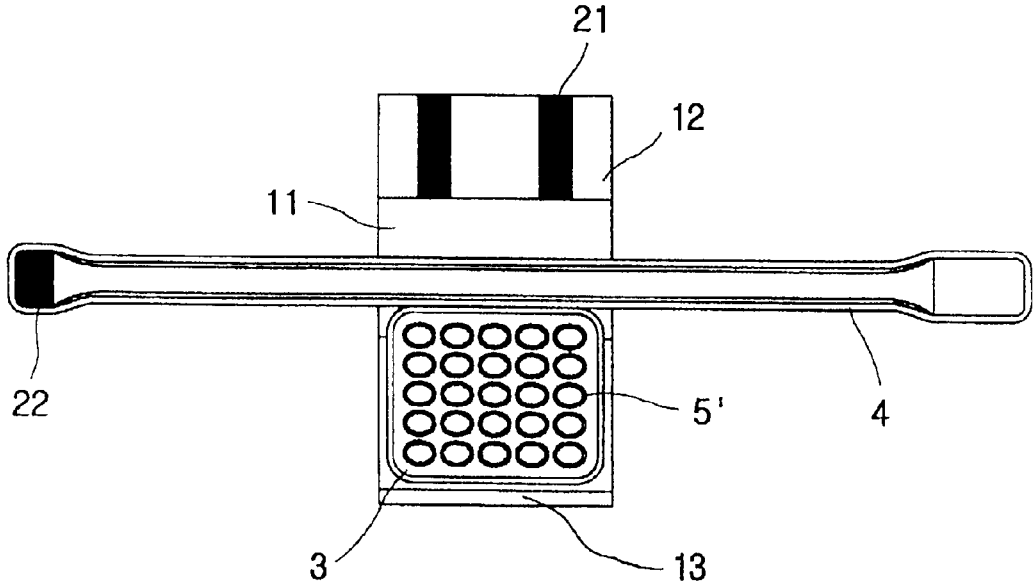
FIG. 5 is a development view of the shock absorbing unit having a third configuration still according to the first embodiment of the present invention.

FIG. 5 is a development view of the side shock absorbing member, the band, the connecting member and a lower panel having a plurality of semispherical prominent air cells instead of the square prominent air cells shown in FIG. 1 to FIG. 4. The plurality of the convex air cells 5 are the same as the above prominent air cells in their operation and effect, except in their configuration.

The Second Embodiment

Figure 6:
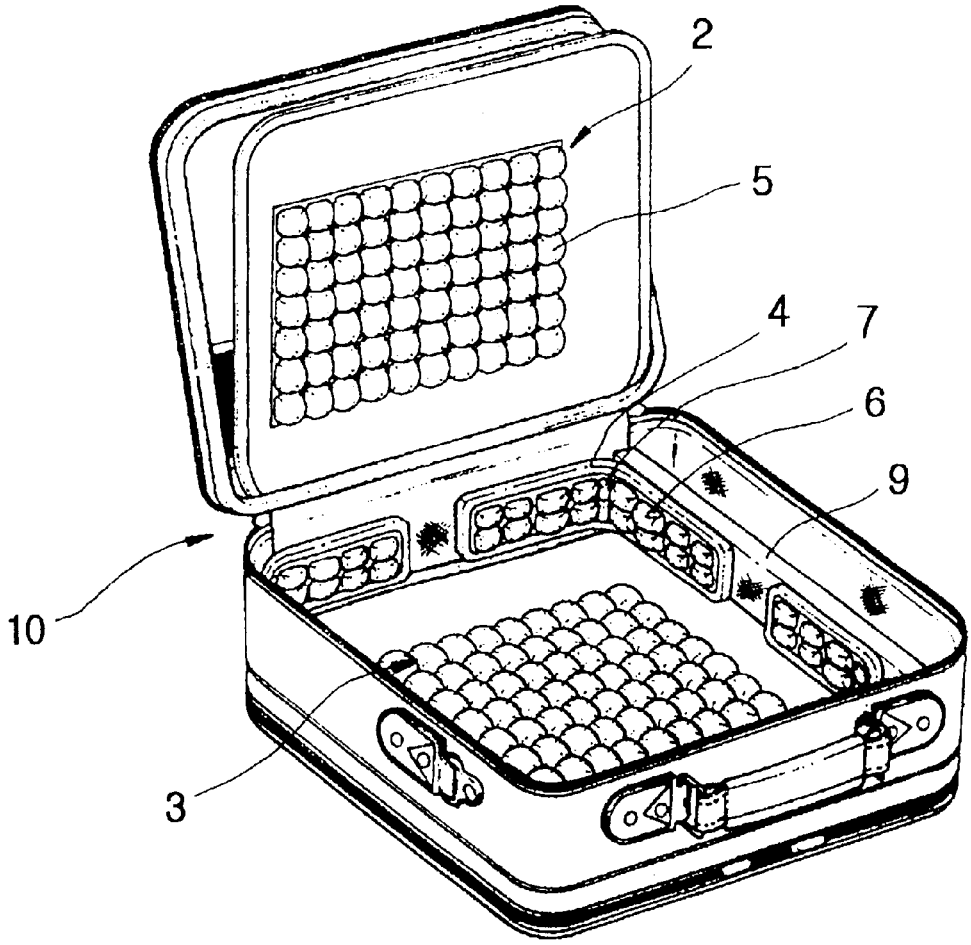
FIG. 6 is a perspective open view showing a bag with a shock absorbing unit according to the second embodiment of the present invention.

FIG. 6 is a perspective open view of a bag with a shock absorbing unit, which shows the second embodiment of the present invention. The bag 10 is a conventional bag having soft side surfaces which includes a receiving space having the upper and lower panels 2, 3 and is constituted with tow outer angled bodies, however it can be any bag having hard surfaces. The upper and lower panels 2, 3 each of which is attached to a bottom surface and an inner panel in the bag 10 respectively, includes a plurality of air cells 5, which are filled with air and sealed. A plurality of the air cells 5 can be formed in either a square shape or a semispherical shape and arranged in a lattice pattern by a compression molding. On the other hand, the four side shock absorbing members 4, attached to the inner wall and four corners of the bag 10, also include a plurality of the prominent air cells 6, filled with air and sealed. The side shock absorbing members 4 are preferably attached, in such a way that they may be detached, to the inner surface of the bag 10 with hook and loop fastener Bonding portions 23 (see FIG. 7) mounted on the rear surface of the side shock absorbing members 4. Therefore, the prominent air cells 5, 6 partially surround the contents of the bag 10.

Each of the air cells 5, 6 is made by sealing after filling air within a TPU resin of high elasticity with use of a compression molding. Because the air cells 5, 6 act as an air cushion, the impact absorbing effect can be maximized. In addition, it is possible to improve the aesthetic appearance by covering their external surface with a covering cloth 8.

Therefore, when carrying the bag 10, the convex air cells 5, 6 support and fix the content therein. Moreover, they can protect the contents from external impact in every direction due to their absorbing effect.

Figure 7:
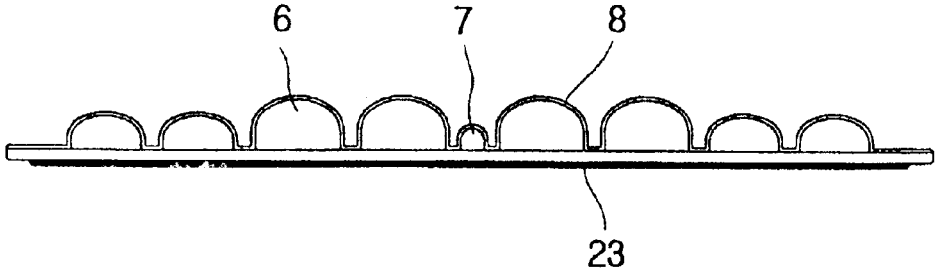
FIG. 7 is a front cross section view of a side shock absorbing member which can be attached to the bag according to the second embodiment of the present invention.

FIG. 7 is a front cross section view of a side shock absorbing member, which can be detachably attached to the bag according to the second embodiment of the present invention. As described above, a plurality of the air cells 6 are formed on a side of the side shock absorbing member 4. On the rear surface of the side shock absorbing member 4, a hook and loop fastener bonding unit 23 is provided such that the side shock absorbing member 4 can be attached to the inner wall surface of the bag 10. The width of the side shock absorbing member 4 is adjusted according to the height of the inner wall surface of the bag 10. On the other hand, an appropriate length thereof may be selected within a range of the width of the bag 10. In addition, the attachment locations of the side shock absorbing member 4 are preferably, but not limited to, four comers. The attachment locations can be selected according to the location of objects in the bag 10 to which special care should be paid for the purpose of protecting them from external impact and depending on the configuration of the contents of the bag 10. On the other hand, it can be seen that a plurality of prominent air cells 6 is in the side shock absorbing member 4 in FIG. 7. The prominent air cell 7 in the position in which the side shock absorbing member 4 is folded in a right angle, can be much smaller or omitted such that the side shock absorbing member 4 can be easily folded without pressing other prominent air cells 6.

Furthermore, the bag 10 with the shock absorbing unit according to the second embodiment of the present invention further includes a partition 9. The partition 9 is preferably made of an absorbing material such as a sponge. The partition 9 has a length corresponding to the vertical length of the bag 10 and has a bonding means such as a hook and loop fastener bonding portion on its end, such that the partition 9 can be attached to the inner wall surfaces on both sides across the bottom surface therein. Therefore, the position of the partition 9 can be fixed so as to separate the receiving space depending on the size of the objects in the bag 10. Accordingly, contents of a relatively small size can be safely fixed without being shaken when the bag 10 is carried, and furthermore the contents can be taken out more easily.

The Third Embodiment

Figure 8:
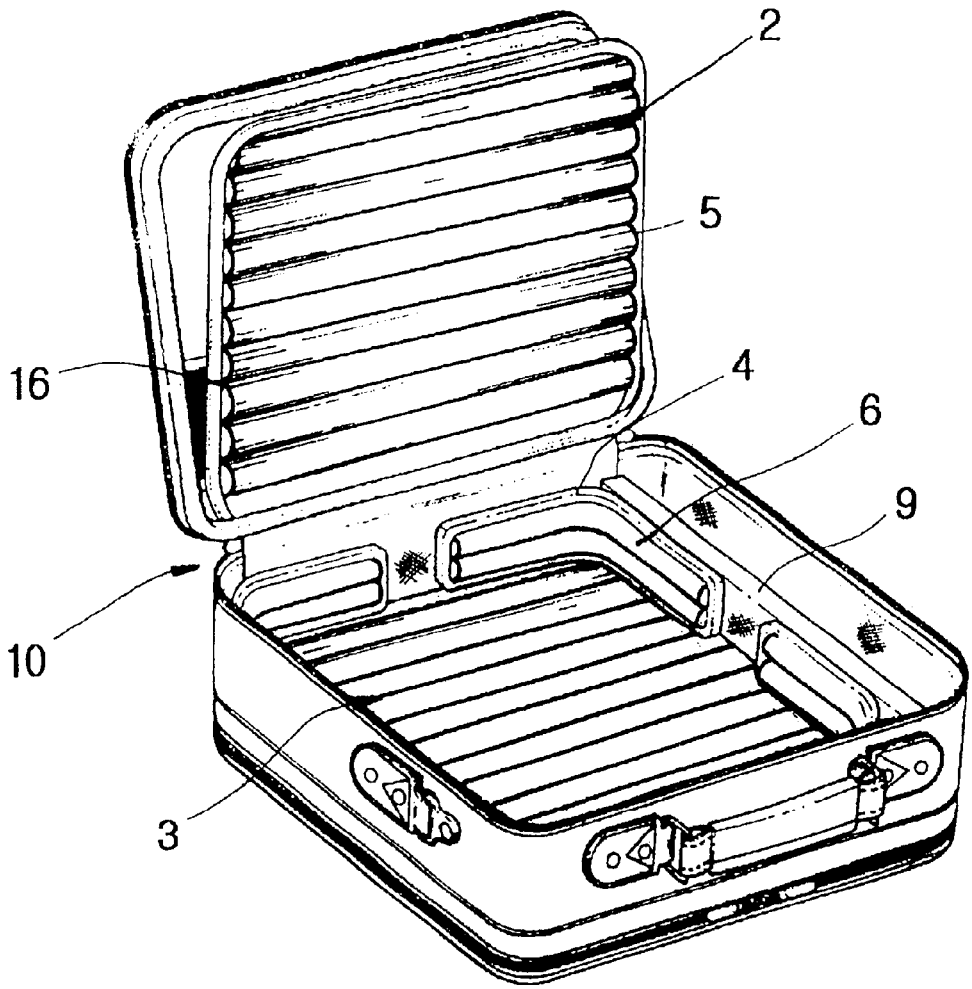
FIG. 8 is a perspective open view of a bag with a shock absorbing unit according to the third embodiment of the present invention.
Figure 9:
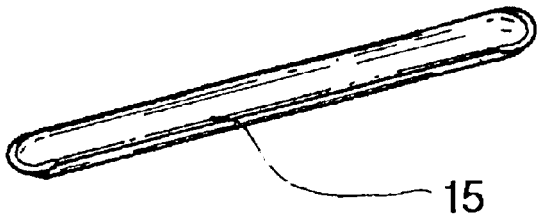
FIG. 9 is a perspective view of an air-filled bar shaped member.

FIG. 8 is a perspective open view of a bag with a shock absorbing unit according to the third embodiment of the present invention. The bag 10 is a bag having a soft side surface which has an internal space for including the upper and lower panels 2, 3 which is constituted of two pieces of outer angled body, however the bag 10 can be any bag having hard side surfaces. While the upper panel 2 is sewed on its upper surface, the lower panel 3 is attached to the bottom surface of the bag with use of a hook and loop fastener bonding portion on the rear surface. The upper and lower panels 2, 3 include a plurality of prominent air cells 5. A plurality of the prominent air cells 5 are made by inserting a thin and long bar shaped member 15 (shown in FIG. 9), made by a compression molding of sealing after filling air in an elastic TPU resin, into tunnel type acceptors 16 disposed in serial rows. On the other hand, the four side shock absorbing members 4, attached to four corners and an inner wall of the bag 10, also have prominent air cells 6 which are a little shorter than the plurality of prominent air cells 5 and formed in the same manner. The side shocking absorbing members 4 include a hook and loop fastener bonding portion 23 (not shown in FIG. 8) on their rear surface such that they can be detachably attached to each inner surface of the bag 10. Therefore, the prominent air cells 5, 6 acts as an air cushion so that the prominent air cells 5, 6 can safely support and fix the contents of the bag 10. In addition, they can protect the contents of the bag 10 by maximizing their absorbing effect of external impacts in all directions. Besides, when at least one of the prominent air cells 5, 6 is damaged thus lessening the shock absorbing effect thereof, it can easily be replaced with a bar shaped member 15 inserted into the acceptor 16. For this reason, the time and cost of maintaining and repairing them can be reduced.

While the width of the side shock absorbing member 4 corresponds to the height of the inner side wall of the bag 10, the length thereof can be selected according to the width of the bag 10. In addition, the locations for attachment to the side shock absorbing member 4 are preferably, but not limited to, the four comers of the bag. The attachment locations can be selected corresponding to the location of those contents to which special care should be paid to protect them from external impact upon consideration of the shape of the contents.

Furthermore, the bag 10 with the shock absorbing unit according to the third embodiment of the present invention further includes the partition 9. The partition 9 is preferably made of a shock absorbing material such as a sponge. The partition 9 has a length corresponding to the total inner rim length of the bag 10 and has a bonding means such as the hook and loop fastener bonding portion in both ends thereof, so that the partition 9 can be attached to the wall surface of both sides across the inner bottom surface. Therefore, the position of the partition 9 can be fixed to separate the receiving space depending on the size of the contents. In such a manner, any object of a relatively small size can be safely fixed without being shaken when the bag 10 is carried, and furthermore the contents can be more easily taken out.

The present invention can be realized in various types without departing from the spirit and scope of the invention. In addition, the present invention is not limited to the illustrated and explained embodiments. All variations within the above description and following claims will be included in the scope of the present invention.

What is claimed is:

1. A bag with a shock absorbing unit for protecting the contents from external impacts, the shock absorbing unit comprising, upper and lower panels(2,3) being air-cushioned with a plurality of air cells(5,6) thereon for absorbing unexpected impacts caused at the top and bottom of the bag(10), each of the air cells(5,6) being inflated with air and sealed;

a side shock absorbing member(4) filled with air and sealed for absorbing the unexpected impacts caused at the side of the bag(10);

a band(11) connected to the side shock absorbing member (4) and made of extensible elastic material; and a connecting member(12) intended to cover the upper panel(2) when the bag(10) is closed, wherein the lower panel(3), the side shock absorbing member(4), the band(11) and the connecting member (12) are all connected making one piece and attached to an inner side wall of the bag(10), and the upper panel(2) is attached to an upper portion of the inner side wall.

2. The bag with a shock absorbing unit as claimed in claim 1, wherein the shock absorbing unit (1) is attached either with use of a hook and loop fastener so as to be easily detached from the bag (10) or by sewing.

3. The bag with a shock absorbing unit as claimed in claim 1, wherein the upper and lower panels(2,3) and the side shock absorbing member(4) can be externally covered with covering cloth(8), and the side shock absorbing member(4) is either formed in a bar-type or with a plurality of air cells(6) facing toward the contents.

4. The bag with a shock absorbing unit as claimed in claim 1, wherein the air cells(5,6) arranged in the upper and lower panels(2,3) and the side shock absorbing member(4) are either square or semi-sphere shaped, and the plurality of the air cells(5,6) are arranged in a lattice pattern by a compression molding.

5. A bag with a shock absorbing unit for protecting the contents from external impacts, the shock absorbing unit comprising:

upper and lower panes (2,3) having a plurality of air cells (5), each of the air cells (5) being inflated with air and sealed; and four side shock absorbing members (4) having a plurality of air cells (6), each of the air cells (6) inflated with air and sealed, and being easily detachable, wherein the upper and lower panels (2,3) are respectively sewed to an internal panel and an inner bottom surface of the bag (10), and the side shock absorbing members (4) are attached to all four corners of the bag (10) and an inner wall of the bag (10) upon consideration of the location, the configuration and the size of the parts of the contents to be protected from external impacts, and further comprising a partition (9) having attachment means at both its ends so as to be attached to opposing inner side walls across the inner bottom of the bag (10) in order to limit the receiving space of the bag (10) depending on the size of the contents.

6. A bag with a shock absorbing unit for protecting the contents from external impacts, the shock absorbing unit comprising:

upper and lower panels (2,3) having a plurality of air cells (5), each of the air cells (5) being inflated with air and sealed; and four side shock absorbing members (4) having a plurality of air cells (6), each of the air cells (6) inflated with air and sealed, and being easily detachable, wherein the upper and lower panels (2,3) are respectively sewed to an internal panel and an inner bottom surface of the bag (10), and the side shock absorbing members (4) are attached to all four corners of the bag (10) upon consideration of the location, the configuration and the size of the parts of the contents to be protected from external impacts, wherein the air cells (5,6) included in the upper and lower panels (2,3) and the side absorbing members(4) are either square or semi-sphere in shape, and wherein a plurality of the air cells(5,6) are arranged in a lattice pattern by means of a compression molding.

* * * * *